US005409736A

United States Patent [19]

Leiner et al.

[11] Patent Number: 5,409,736

[45] Date of Patent: Apr. 25, 1995

[54] DEACIDIFICATION OF CELLULOSE BASED MATERIALS USING PERFLUORINATED CARRIERS

[75] Inventors: Lee H. Leiner, New Kensington; Edward W. Kifer, Trafford, both of Pa.

[73] Assignee: Preservation Technologies, Inc., Glenshaw, Pa.

[21] Appl. No.: 114,434

[22] Filed: Aug. 31, 1993

[51] Int. Cl.[6] ..... B05D 3/02

[52] U.S. Cl. ..... 427/372.2; 427/343; 427/439

[58] Field of Search ..... 427/140, 180, 391, 439, 427/337, 343, 395, 372.2

[56] References Cited

U.S. PATENT DOCUMENTS

| | | | |
|---|---|---|---|
| 3,665,041 | 5/1972 | Sianesi et al. | 260/615 A |
| 3,676,182 | 7/1972 | Smith | 427/439 |
| 3,810,874 | 5/1974 | Mitsch et al. . | |
| 3,898,356 | 8/1975 | Williams et al. | 427/343 |
| 3,939,091 | 2/1976 | Kelly, Jr. | 427/439 |
| 3,969,549 | 7/1976 | Williams et al. | 427/248 |
| 4,522,843 | 6/1985 | Kundrot | 427/475 |
| 4,523,039 | 6/1985 | Lagow et al. | 568/615 |
| 5,208,072 | 5/1993 | Kamienski et al. | 427/439 |

*Primary Examiner*—Diana Dudash

*Attorney, Agent, or Firm*—Kirkpatrick & Lockhart

[57] ABSTRACT

An improved method of deacidifying books, imaged paper and other imaged materials having a cellulose base wherein, for a sufficient time to raise the pH of the materials, the materials are treated with alkaline particles of a basic metal oxide, hydroxide or salt dispersed in an inert perflourinated carrier, preferably selected from the group consisting of perfluoropolyoxyether, perfluoromorpholine and combinations thereof. Perfluoropolyoxyether alkanoic acid is added as a surfactant. Alternatively, when perfluoromorpholine is the carrier of choice, the surfactant may instead be potassium fluoroalkyl carboxylate.

7 Claims, No Drawings

DEACIDIFICATION OF CELLULOSE BASED MATERIALS USING PERFLUORINATED CARRIERS

BACKGROUND OF THE INVENTION

1. Field of the Invention

The present invention relates to the deacidification of cellulose based materials, and more particularly, to an improved method for deacidifying such materials.

2. Description of the Invention Background

The deterioration of paper, books and newspapers is well-known and of growing concern to librarians and archivists throughout the world. The causes of paper deterioration are numerous and include inherent acidity, photodegradation, oxidation, and even microbiological attack under certain conditions. These factors combined with initial paper quality have severely reduced the permanence of library and archival collections. It is becoming generally accepted that the most insidious problem is the acidity of most book paper produced in the last one hundred years.

The demand for large amounts of printing paper over the last century led to the introduction of pulp fiber produced from wood by chemical or mechanical means. However, paper made from untreated wood pulp is too absorbent to allow sharp image imprint. Therefore, chemicals have to be added to the wood fibers during processing. These additives allow the paper to accept inks and dyes and increase paper opacity. Unfortunately, most of these chemicals are either acidic or are deposited by acidic mechanisms which initiate the slow, but relentless acidic deterioration of paper. Other contributions to the acidification of paper are supplied by man through industrial emissions of sulphur and nitrogen and carbon oxides or by natural processes such as sea salt spray. Even books or paper of neutral and alkaline characters are not immune. As neighboring papers of acidic nature degrade, volatile acids are produced which either diffuse through adjoining books or permeate the atmosphere and may ultimately acidify even the "safe or stable" books.

In order to arrest this acidic degradation, paper materials must be deacidified and provided with an alkaline reserve or buffer to retard a return to an acidic state. There are several known processes, several in the development stage, for deacidifying paper whether bound or unbound. Numbering among these are processes using volatile metal alkyls, e.g. U.S. Pat. Nos. 3,969,549, and 4,051,276, and volatile amines e.g. U.S. Pat. Nos. 3,472,611, 3,771,958 and 3,703,353. U.S. Pat. No. 3,676,182 issued Jul. 11, 1972 describes the treatment of cellulosic materials with alkali and alkaline earth bicarbonates, carbonates, and hydroxides in a halogenated hydrocarbon solvent or lower aliphatic hydrocarbon such as n-butane with an optional plasticizing agent such as ethylene glycol. U.S. Pat. No. 3,676,055 issued Jul. 11, 1972 to Smith describes a nonaqueous deacidification solution for treating cellulosic materials comprising 1000 cc of 7 percent magnesium methoxide in methanol and in addition 20 pounds of dichlorodifluoromethane (Freon 22). Canadian Pat. No. 911,110 issued Oct. 3, 1982 to Smith describes a deacidification solution of a 7% magnesium methoxide solution in methanol (10 parts) and a halogenated solvent or solvents (90 parts): and states that a magnesium alkoxide reacts with water in paper to form a mildly alkaline milk of magnesia, being magnesium hydroxide. Improved results are reported with the use of the halogenated hydrocarbon solvents.

Unfortunately, all of these processes suffer from one or more of a number of drawbacks that have prevented their widespread acceptance. These drawbacks include high cost, toxicity, complexity of treatment, residual odor, deleterious effects on certain types of paper and inks, lack of an alkaline reserve, and the necessity of drying the book or paper to very low moisture contents before treatment.

Kundrot, U.S. Pat. No. 4,522,843, which issued Jun. 11, 1985, provided a solution to the problems experienced with prior art systems. The method of the Kundrot patent utilizes a dispersion of alkaline particles of a basic metal oxide, hydroxide or salt, such as magnesium oxide, in a gas or liquid dispersant. The MgO, when converted to $Mg(OH)_2$, according to the reaction $MgO+H_2O \rightarrow Mg(OH)_2$ effectively neutralizes the initial acidity in the paper and provides an adequate alkaline reserve to counter future reacidification. The deacidification reactions occur later (a period of days) and are typically described as $Mg(OH)_2+H_2SO_4 \rightarrow MgSO_4+2\ H_2O$. The liquid dispersant or carrier, is an inert halogenated hydrocarbon. It does not take part in the deacidification, but serves to carry the particles to the fabric of the paper. In several embodiments described, the halogenated hydrocarbons are Freons, or chlorofluorocarbons (CFC). CFC's have since been found to harm public health and the environment by depleting ozone in the upper atmosphere. Manufacturers of CFC's presently place limits on the amounts they will sell to any one purchaser and are phasing out production of CFC's entirely.

Accordingly, a replacement for the CFC carrier in the method of deacidifying books and other cellulose based materials described in the Kundrot patent is needed. The replacement medium must not damage the cellulose based materials by discoloring pages or leather bindings and covers, causing inks to run or fade or weakening bindings.

SUMMARY OF THE INVENTION

The present invention provides an improvement in a method for deacidifying cellulose based materials, such as books, magazines, newspapers, maps, documents, photographs and postcards, facsimile paper, folders, imaged paper and the like. The method involves generally treating the cellulose based materials with alkaline particles of a basic metal selected from the group consisting of oxides, hydroxide and salts, dispersed in a carrier liquid or similar dispersion medium, in an amount and for a time sufficient to pass the alkaline particles into the interstices of the materials and increase the pH of the materials. The improvement comprises dispersing the alkaline particles in an inert medium comprised of a perflourinated carrier and an associated surfactant, preferably selected from the group consisting of perfluoropolyoxyether as the carrier and perfluoropolyoxyether alkanoic acid as the associated surfactant, perfluoromorpholine as the carrier and perfluoropolyoxyether alkanoic acid or potassium fluoroalkylcarboxylate as the associated surfactant and perflouroalkane as the carrier and perflouropolyoxyether alkanoic acid or Forafac 1033 as the associated surfactant. Forafac 1033 is manufactured by Atochem of France. Perflouropolyoxyether alkanoic acid is sold commercially under the trademark Fomblin ® by Ausimont of Morristown, N.J. The new carriers have an ozone depletion potential of zero and thus, are ecologically preferable to the CFC's used in the past.

DESCRIPTION OF THE PREFERRED EMBODIMENTS

The cellulosic materials can be treated with any suitable basic metal oxide, hydroxide or salt as described in U.S. Pat. No. 4,522,843 to Kundrot, which is hereby incorporated by reference. Suitable materials, according to the Kundrot patent, are the oxides, hydroxides, carbonates and bicarbonates of the Group I and II metals of the Periodic table and zinc. Preferred are the materials in which the cation is magnesium, zinc, sodium, potassium, or calcium. Particularly preferred are the relatively non-toxic oxides, carbonates and bicarbonates of magnesium and zinc and the hydroxides of sodium, potassium and calcium. Representative examples include magnesium oxide, magnesium carbonate, magnesium bicarbonate, zinc carbonate, zinc bicarbonate, zinc oxide, sodium hydroxide, potassium hydroxide and calcium hydroxide. Magnesium oxide is most preferred. The predominate particle size (95–99%) is preferably between 0.01 and 1.0 micron. To avoid hazards due to fumes (magnesium oxide fumes are composed of particles sized between 0.02–0.05 micron), the particles used in the process are preferably near the upper end of the range, between about 0.2 and 1.0 micron. Typical surface areas are between 50 and 200 $m^2/g$ BET, preferably about 170–180 $m^2/g$.

The particles can be formed by burning the elemental metal and collecting the smoke, attrition of the preformed oxides or calcination of the elemental salts. For example, basic magnesium carbonate can be calcined at 450° C.–550° C. to produce a polydisperse high activity magnesium oxide with an average particle size of 0.4 microns and a predominant particle size between 0.1 and 1.0 micron. The smaller particles can be filtered out.

The particles can be applied in the paper making process or to the finished paper by immersing the paper in a suspension of the non-aqueous inert deacidifying fluid. Inert as used herein means that there is a very low interaction, and preferably no interaction, between the fluid medium and inks, dyes, bindings, cover materials and the like in the cellulose based materials. The inert fluid medium of the present invention includes a perflourinated carrier and a surfactant that will disperse the alkaline particles in the carrier.

When it became apparent that CFC's could no longer be used as the liquid dispersant in the deacidification process of the Kundrot patent, a search for a replacement ensued. A number of possible replacements were examined and tested in the process. It is believed that samples representative of the entire range of papers used in the United States were included in the testing, such as that found in hard cover and soft cover books, encyclopedias, periodicals, newspapers, magazines, comic books and other documents. In addition, the tests were run on a variety of bindings including backrams, leathers, synthetic leathers and polymers. Table I identifies several carriers tested and the results obtained for each. Most were determined to be ill suited for use in the deacidification process. Only the perfluoro compounds consistently performed well.

TABLE I

| | |
|---|---|
| Isopropyl Chloride | No damage to paper. Some solubility for inks, especially blue ball point pen. Very high solubility for electrostatic copies. Damage to binding materials. |
| 1,1 dichloro-1-fluoroethane (sold under the name HCFC-141) | No damage to paper. Very slight feathering of blue ball point ink. High solubility of electrostatic copies. Some damage to bindings. |
| 2,2 dichloro-1,1,1-trifluoroethance (sold under the name HCFC-123) | No damage to paper. Some feathering of newsprint and blue ball point. Feathers electrostatic copies. Damages bindings. |
| Hexane | No damage to paper. Some damage to leather bindings. Some feathering of electrostatic copies. Damage to inexpensive bindings. |
| Perfluoroalkanes | No damage to paper, bindings, inks or electrostatic copies. |
| Perfluoromorpholine | No damage to paper, bindings, inks or electrostatic copies. |
| Perfluoropolyoxyethers | No damage to paper, bindings, inks or electrostatic copies. |

Based on the screening tests, the perfluoro compounds, perfluoroalkanes, perfluoromorpholine (PF-morpholine) and perfluoropolyoxyether (PF-poxyether) were determined to be the best candidates for substitutes for the CFC's used in the deacidification process. Perfluoroalkane is a halogenated hydrocarbon. The perfluoromorpholine and perfluoropolyoxyethers are not pure hydrocarbons, both having noncarbon constituents in their core structures. Both are nonflammable. PF-poxyether is used typically as a heat transfer material in the electronics industry. As provided in the Kundrot patent, a suitable carrier for a liquid suspension of particles is preferably inert and possesses a high enough vapor pressure to allow its removal from the paper following treatment. It is believed that the full flourination of the perfluoro compounds renders them inert for purposes of the deacidification process. The boiling points for the preferred substitutes range between about 25° C. to about 80° C.

A surfactant is important for the proper dispersion of the alkaline particles throughout the carrier. It was soon discovered, however, that not all surfactants work adequately or at all in the deacidification process with the new carriers. Tests were done to determine if any surfactant would work in the deacidification process with the perfluoro compounds as carrier and, if so, which ones. Solubility, dispersion and residual odor were tested. All of the surfactants tested are commercially available compounds. The results are set forth in Tables 2–4. The surfactants tested are listed below by their tradenames. Where the generic name could be determined, it too is provided. The chemical nature of some of the surfactants tested are tradesecrets and the manufacturers declined to identify them.

TABLE 2

| | Solubility | |
|---|---|---|
| *Surfactant | PF-Morpholine | PF-poxyether |
| Surfynol CT-136 | N | N |
| Surfynol CT-141 | N | N |
| Surfynol CT-324 | N | N |
| Silwet L-77 (silicone polyether copolymer) | N | N |
| Niaproof 4 | N | N |
| Niaproof 08 | N | N |
| Zonyl FSA (lithium fluoroalkyl carboxylate) | N | S |
| Zonyl FSB (ammonium fluoroalkyl phosphate) | N | S |

TABLE 2-continued

| *Surfactant | Solubility PF-Morpholine | PF-poxyether |
|---|---|---|
| Forafac 1033 | S | S |
| Forafac 1110 | N | N |
| Ninate 411 | N | N |
| Makon 4 | N | N |
| Kessco GMS (glycerol stearate) | N | N |
| Fluorad FC-98 (potassium perfluoroalkyl sulfonate) | S | S |
| Fluorad FC-120 (ammonium perfluoroalkyl sulfonate) | N | N |
| Fluorad FC-170-C | N | N |
| Fluorad FC-171 (fluorinated alkyl alkokylates) | S | S |
| Fluorad FC-129 (potassium fluoroalkyl carboxylate) | Y | S |
| Fluorad FC-135 (fluorinated alkyl quaternary ammonium iodide) | N | N |
| Fluorad FC-430 | N | S |
| Fluorad FC-431 (fluoroaliphatic polymeric ester) | N | S |
| Fluorad FC-740 (fluorinated alkyl polymeric ester) | S | S |
| Fluorad FC-100 (fluoroalkyl sulfonate, sodium salt) | N | N |
| Atsurf 1910 | N | N |
| Arlatone G (polyoxyethylene fatty glyceride) | N | N |
| Tween 85 | N | |
| Hypermer LP1 | S | N |
| Hypermer LP4 | N | N |
| Hypermer LP5 | N | N |
| Hypermer LP6 | N | N |
| Hypermer LP7 | N | N |
| Hypermer B246 | N | N |
| Span 85 (sorbitan trioleate) | N | N |
| IL-2457 | N | N |
| PS-3 (polyester/polyamine copolymer) | N | N |
| PS-4 (polyester/polyamine copolymer) | N | N |
| Disperby K-182 | N | N |
| BYK-W995 | N | N |
| Fomblin ® (perfluor polyoxyether alkanoic acid) | Y | Y |

N - None; S - Slight; Y - >500 ppm
*Refer to Table 4 for manufacturers

As shown in Table 2, only two surfactants tested were sufficiently soluble in the carriers of choice. The rest were either not soluble or only slightly soluble and therefore, would not be good surfactants for use in the instant deacidification process when PF-morpholine or PF-poxyether are used as the carrier.

TABLE 3

| *Surfactant | Dispersion PF-Morpholine | PF-poxyether |
|---|---|---|
| Surfynol CT-136 | N | N |
| Surfynol CT-141 | N | N |
| Surfynol CT-324 | N | N |
| Silwet L-77 | N | P |
| Niaproof 4 | N | N |
| Niaproof 08 | N | N |
| Zonyl FSA | P | N |
| Zonyl FSB | P | N |
| Forafac 1033 | P | P |
| Forafac 1110 | N | N |
| Ninate 411 | N | N |

TABLE 3-continued

| *Surfactant | Dispersion PF-Morpholine | PF-poxyether |
|---|---|---|
| Makon 4 | N | N |
| Kessco GMS | N | N |
| Fluorad FC-98 | P | N |
| Fluorad FC-120 | N | N |
| Fluorad FC-170-C | N | N |
| Fluorad FC-171 | P | N |
| Fluorad FC-129 | E | P |
| Fluorad FC-135 | N | N |
| Fluorad FC-430 | N | N |
| Fluorad FC-431 | N | N |
| Fluorad FC-740 | P | P |
| Fluorad FC-100 | N | N |
| Atsurf 1910 | N | N |
| Arlatone G | N | N |
| Tween 85 | N | N |
| Hypermer LP1 | N | N |
| Hypermer LP4 | N | N |
| Hypermer LP5 | N | N |
| Hypermer LP6 | N | N |
| Hypermer LP7 | N | N |
| Hypermer B246 | P | N |
| Span 85 | N | N |
| IL-2457 | N | N |
| PS-3 | N | N |
| PS-4 | N | N |
| Disperby K-182 | N | N |
| BYK-W995 | N | N |
| Fomblin | E | E |

N - None; P - Poor; G - Good; E - Excellent
*The tradenames are used in Table 3 for brevity. Refer to Table 2 for generic names, where available.

As shown in Table 3, most of the surfactants tested demonstrated no ability or a poor ability to disperse the alkaline particles in the carriers of choice.

The odor test was conducted by fanning the book, magazine or other cellulose based material being evaluated after treatment using one of the following surfactants in the treatment bath and recording the first impression on a scale of 0 to 5, from no odor at all to an overpowering odor.

TABLE 4

| Manufacturer | Odor Surfactant | Odor |
|---|---|---|
| Air Products Inc. | Surfynol CT-136 | 2 |
| Allentown, Pennsylvania | Surfynol CT-141 | 1 |
| | Surfynol CT-32 | 2 |
| Union Carbide Danbury, Connecticut | Silwet L-77 | 1 |
| Niacet | Niaproof 4 | 4 |
| Buffalo, New York | NiaRroof 08 | 4 |
| E. I. duPont deNemours | Zonyl FSA | 3 |
| Wilmington, Delaware | Zonyl FSB | 2 |
| Atochem | Forafac 1033 | 2 |
| France | Forafac 1110 | 4 |
| Stepan Company | Ninate 411 | 1 |
| Northfield, Illinois | Makon 4 | 0 |
| | Kessco GMS | 1 |
| 3M Company | Fluorad FC-98 | 0 |
| St. Paul, Minnesota | Fluorad FC-120 | 5 |
| | Fluorad FC-170-C | 3 |
| | Fluorad FC 171 | 1 |
| | Fluorad FC-129 | 2 |
| | Fluorad FC-135 | 4 |
| | Fluorad FC-430 | 3 |
| | Fluorad FC-431 | 4 |
| | Fluorad FC-740 | 3 |
| | Fluorad FC-100 | 2 |
| ICI Americas | Atsurf 1910 | 2 |
| Wilmington, Delaware | Arlatone G | 1 |
| | Tween 85 | 2 |
| | Hypermer LP1 | 1 |
| | Hypermer LP4 | 2 |
| | Hypermer LP5 | 2 |
| | Hypermer LP6 | 5 |

TABLE 4-continued

| Manufacturer | Surfactant | Odor |
|---|---|---|
| | Hypermer LP7 | 3 |
| | Hypermer B246 | 3 |
| | Span 85 | 1 |
| | IL-2457 | 2 |
| | PS-3 | 2 |
| | PS-4 | 2 |
| BYK Chemie | Disperby K-182 | 3 |
| Germany | BYK-W995 | 2 |
| Ausimont | Fomblin | 0 |
| Morristown, New Jersey | | |

5 - very strong, over powering odor; 4 - strong odor; 3 - moderate odor; 2 - weak odor; 1 - barely detectable odor; 0 - no detectable odor
*Refer to Table 2 for generic names, where available The foregoing tests indicate that all the surfactants examined, only one, perfluoropolyoxyether alkanoic acid (Fomblin®), is suitable for use with the PF-poxyether carrier, and only two are suitable for use with PF-Morpholine, perfluoropolyoxyether alkanoic acid (Fomblin®) and potassium fluoroalkyl carboxylate (Fluorad-129), with the former being preferred because of the absence of any odor following treatment.

In use, a bath of an inert carrier and its suitable associated surfactant is prepared by adding to the carrier an amount of the appropriate surfactant, preferably four hundred parts per million (0.0004). The alkaline particles are then added and dispersed throughout the carrier-surfactant medium.

The amount of surfactant and alkaline material will depend in part on the length of treatment and the amount of deposition desired. The carrier is present in excess amounts, sufficient to immerse the quantity of materials being treated. Generally, however, the concentration of alkaline material will be between about 0.01 and about 0.3 weight percent. A most preferred range for the basic material particles is between about 0.01% and about 0.2%, the preferred range for the surfactant is between about 0.03 wt % and about 0.05 wt %. The preferred alkaline particles, MgO, are generally present in a dispersion maintained at approximately 1.5–2.0 g/L MgO based on the volume of the carrier. The cellulose based materials are immersed into the bath, and preferably moved in a reciprocating, generally horizontal direction at a predetermined speed and over a predetermined length, as described in co-pending U.S. patent application, Ser. No. 105,754 for Method and Apparatus For the Deacidification of Library Materials. The movement is preferably continued for 12–15 minutes at room temperature. Alternatively, the suspension can be sprayed onto the pages of a book or other document.

The suspension permeates the fibers of the paper leaving alkaline particles behind when the carrier and surfactant medium are evaporated. The pH of the paper is thereby raised and an alkaline reserve of at least 300 milliequivalents reserve per kilogram of paper remains in the fiber of the paper. Paper treated with the improved process of the present invention typically show a pH value ranging from 7.5 to 9.5.

The following example demonstrates that the pH of test strips of paper was raised using the improved process of the present invention.

EXAMPLES

Two baths were made, each consisting of a liter batch of inert carrier, 0.04 wt % perfluoropolyoxyether alkanoic acid as surfactant and 1.5 g/L magnesium oxide particles in a dispersion. The inert carrier was PF-morpholine in the first bath, and PF-poxyether in the second bath. Strips of clear spring offset paper taken from a Library of Congress test book were tested as follows:

The pH of the strips of paper prior to treatment ranged from 4.5 to 5.0. Seven strips were placed in the first bath and five strips were placed in the second bath at room temperature and ambient pressure. After two minutes in the bath, the paper strips were removed and permitted to air dry. The pH of each of the seven strips of paper treated in the first bath containing the PF-morpholine carrier was 9.2. The pH of each of the five strips of paper treated in the second bath containing the PF-poxyether carrier was 9.1.

What is claim is:

1. In a method of deacidifying cellulose based materials which includes the step of contacting said material with alkaline particles of a basic metal oxide, hydroxide or salt dispersed in a liquid carrier in an amount and for a time sufficient to pass said particles into the interstices of the cellulose based materials and increase the pH thereof, the improvement comprising:

dispersing said particles in an inert medium comprised of said liquid carrier and a surfactant, wherein the liquid carrier is a perfluorinated compound.

2. In a method of deacidifying cellulose based materials which includes the step of contacting the materials with alkaline particles of a basic metal oxide, hydroxide or salt dispersed in a liquid carrier in an amount and for a time sufficient to pass said particles into the interstices of the materials and increase the pH thereof, the improvement comprising:

dispersing said particles in an inert medium comprised of the liquid carrier and a surfactant wherein the surfactant is perfluoropolyoxyether alkanoic acid.

3. In a method of deacidifying cellulose based materials which includes the step of contacting the materials with alkaline particles of a basic metal oxide, hydroxide or salt dispersed in a liquid carrier in an amount and for a time sufficient to pass said particles into the interstices of the materials and increase the pH thereof, the improvement comprising:

dispersing said particles in an inert medium comprised of the liquid carrier and a surfactant wherein the liquid carrier and surfactant are selected from the group consisting of perfluoropolyoxyether as the liquid carrier and perfluoropolyoxyether alkanoic acid as the surfactant, and perfluoromorpholine as the liquid carrier and either perfluoropolyoxyether alkanoic acid or potassium fluoroalkyl carboxylate as the surfactant.

4. The method of claim 3 wherein the surfactant is present in amounts of between 0.03 and 0.05 weight percent.

5. The method of claim 2 wherein the alkaline particles are present in amounts between about 0.01 and 0.3 weight percent.

6. The method of claim 2 wherein the surfactant is present in amounts of between 0.03 and 0.05 weight percent.

7. The method of claim 3 wherein the alkaline particles are present in amounts between about 0.01 and 0.3 weight percent.

* * * * *

UNITED STATES PATENT AND TRADEMARK OFFICE

CERTIFICATE OF CORRECTION

PATENT NO. : 5,409,736

DATED : April 25, 1995

INVENTOR(S) : Lee H. Leiner and Edward W. Kifer

It is certified that error appears in the above-indentified patent and that said Letters Patent is hereby corrected as shown below:

Col. 5, line 32, in surfactant for tween 85, under the column "PF-poxyether" add --N--.

Signed and Sealed this

Twenty-fifth Day of July, 1995

Bruce Lehman

*Attest:*

BRUCE LEHMAN

*Attesting Officer*

*Commissioner of Patents and Trademarks*